US011279583B2

(12) United States Patent
Herpell

(10) Patent No.: US 11,279,583 B2
(45) Date of Patent: Mar. 22, 2022

(54) SUCTION CONVEYOR DEVICE FOR TRANSPORTING FLAT ITEMS, AND SYSTEM FOR PRODUCING FLAT ITEMS COMPRISING SAID TYPE OF SUCTION CONVEYOR

(71) Applicant: BW Papersystems Hamburg GmbH, Wedel (DE)

(72) Inventor: Frank Herpell, Hamburg (DE)

(73) Assignee: BW Papersystems Hamburg GmbH, Wedel (DE)

( * ) Notice: Subject to any disclaimer, the term of this patent is extended or adjusted under 35 U.S.C. 154(b) by 146 days.

(21) Appl. No.: 16/574,973

(22) Filed: Sep. 18, 2019

(65) Prior Publication Data

US 2020/0055687 A1 Feb. 20, 2020

Related U.S. Application Data

(62) Division of application No. 14/397,047, filed as application No. PCT/EP2013/058626 on Apr. 25, 2013, now abandoned.

(30) Foreign Application Priority Data

Apr. 25, 2012 (DE) ..... 10 2012 206 847.3

(51) Int. Cl.
*B65H 29/24* (2006.01)
*B26D 7/32* (2006.01)
(Continued)

(52) U.S. Cl.
CPC ..... *B65H 29/242* (2013.01); *B26D 7/32* (2013.01); *B65H 31/00* (2013.01); *B65H 35/00* (2013.01);
(Continued)

(58) Field of Classification Search
CPC .... B32B 38/1866; B65G 39/04; B65G 39/10; B65G 39/16; B65G 39/71; B65G 5/224;
(Continued)

(56) References Cited

U.S. PATENT DOCUMENTS 2,568,174 A * 9/1951 Staacke ..... B65G 39/071 198/843
2,686,590 A 8/1954 Sloane
(Continued)

FOREIGN PATENT DOCUMENTS

CN 1145874 A 3/1997
CN 104583632 B 1/2018
(Continued)

OTHER PUBLICATIONS

The Examination Report dated Dec. 10, 2015 for Chinese Application No. 201380033729.2, 10 pages.
(Continued)

*Primary Examiner* — Laura M Lee
(74) *Attorney, Agent, or Firm* — Andrus Intellectual Property Law, LLP

(57) ABSTRACT

A suction conveyor device comprising a suction arrangement having a suction side on which low pressure is generated, continuously rotating flexible conveying means made of flexible flat material having holes, an inner side enabling the conveying means to move along the suction side, and an outer side for receiving flat items in the active area of the suction side, where the conveying means moves in the transporting direction, the suction arrangement and the conveyor means designed with a transport path width in the active range perpendicular to the transporting direction. The conveying means includes continuously circulating individual, single-piece, flexible conveying means, both lateral edges thereof extending in the transporting direction
(Continued)

at a distance from each other being at least the same as the total width of the transport path such that the individual, single-piece flexible conveyor means extend over the total width of the transport path.

18 Claims, 10 Drawing Sheets

(51) Int. Cl.
*B65H 35/00* (2006.01)
*B65H 31/00* (2006.01)
*B42C 19/06* (2006.01)

(52) U.S. Cl.
CPC ..... *B26D 2007/322* (2013.01); *B42C 19/06* (2013.01); *B65H 2301/44512* (2013.01); *B65H 2403/20* (2013.01); *B65H 2404/252* (2013.01); *B65H 2404/511* (2013.01); *B65H 2406/32* (2013.01); *B65H 2801/48* (2013.01); *Y10T 83/207* (2015.04)

(58) Field of Classification Search
CPC ..... B65H 27/00; B65H 2404/132; B65H 23/0258; B65H 2406/32; B65H 15/64; B65H 11/005; B65H 29/242; H65H 5/224; H65H 5/22; Y10T 83/207
USPC ..... 242/615.12, 615.4; 271/197
See application file for complete search history.

(56) References Cited

U.S. PATENT DOCUMENTS

| | | | | |
|---|---|---|---|---|
| 2,925,168 | A | 2/1960 | Lorig | |
| 3,405,855 | A | 10/1968 | Daly et al. | |
| 3,477,558 | A | 11/1969 | Fihischauer | |
| 3,786,975 | A | 1/1974 | Heymanns | |
| 4,298,277 | A | 11/1981 | Silverberg | |
| 4,564,297 | A | 1/1986 | Firth | |
| 4,832,186 | A * | 5/1989 | Conrad | B65G 39/16 198/806 |
| 5,050,727 | A | 9/1991 | Akesaka | |
| 5,194,050 | A | 3/1993 | Muraishi et al. | |
| 5,213,202 | A | 5/1993 | Arnold | |
| 5,729,878 | A | 3/1998 | Kurihara et al. | |
| 5,785,310 | A | 7/1998 | Kohn | |
| 6,394,596 | B1 * | 5/2002 | Wotton | B41J 11/007 226/172 |
| 6,575,459 | B1 | 6/2003 | Kakiwaki et al. | |
| 8,113,515 | B2 | 2/2012 | Komiyama et al. | |
| 8,303,106 | B2 | 11/2012 | Kasiske et al. | |
| 8,870,174 | B2 * | 10/2014 | Mueller | B42C 19/06 270/52.07 |
| 2005/0077171 | A1 | 4/2005 | Hagemann | |
| 2011/0103928 | A1 | 5/2011 | Holbrook et al. | |
| 2015/0096415 | A1 | 4/2015 | Herpell | |

FOREIGN PATENT DOCUMENTS

| | | | |
|---|---|---|---|
| DE | 4239561 | C2 | 10/2000 |
| DE | 102009048928 | A1 | 4/2011 |
| JP | S48-87905 | A | 11/1973 |
| JP | 2007210750 | A | 8/2007 |
| JP | 2009234209 | A | 10/2009 |

OTHER PUBLICATIONS

The Examination Report dated Dec. 12, 2012 for German Application No. 10 2012 206 847.3, 9 pages.
International search Report and Written Opinion dated Sep. 27, 2013 from PCT Application No. PCT/EP2013/058626, 17 pages.

* cited by examiner

SUCTION CONVEYOR DEVICE FOR TRANSPORTING FLAT ITEMS, AND SYSTEM FOR PRODUCING FLAT ITEMS COMPRISING SAID TYPE OF SUCTION CONVEYOR

CROSS-REFERENCE TO RELATED APPLICATION

The present application is a divisional of U.S. patent application Ser. No. 14/397,047, filed Oct. 24, 2014, which application was published on Apr. 9, 2015, as US2015/0096415 in the English language, which application is the U.S. national stage application of International Application No. PCT/EP2013/058626, filed Apr. 25, 2013, which international application was published on Oct. 31, 2013, as International Publication WO2013/160399 in the German language. The above-noted applications are incorporated herein by reference, in their entireties. The international application claims priority to German Patent Application No. 102012206847.3, filed Apr. 25, 2012, which is incorporated herein by reference, in its entirety.

The invention relates to a suction conveyor device for transporting flat items, particularly sheets of paper, preferably on the path between a cutting station and a stack forming station in a system of the paper processing industry, with a suction arrangement having a suction side on which a low pressure is generated, and a continuously circulating flexible conveying means arrangement that is made of a flexible flat material provided with holes, and an inner side which enables the conveying means arrangement to move along the suction side of the suction arrangement, and an outer side for receiving the flat items in the active area of the suction side of the suction arrangement, where the conveying means arrangement moves in the direction of conveyance, the suction arrangement and the conveying means arrangement being embodied such that a transport path is defined in the active range of the suction side of the suction arrangement whose width transverse to the direction of conveyance enables the simultaneous receiving of at least two flat items lying side by side.

"Flat items" particularly include sheets of paper of the paper of the paper processing industry that are preferably further processed into books, but also other flat items such as sections of film made of plastic, metal, non-woven fabrics, paper or the like; however, the flat items at issue here are not limited thereto.

The essence of a suction conveyor device consists in subjecting the flat parts to be transported not only with an advancement motion in the direction of conveyance, but also simultaneously acting on the flat parts with low pressure. Continuously circulating conveyor belts that form the conveying means arrangement together provide for the movement in the direction of conveyance and hence for the transporting of the flat parts. The suction device is responsible for impinging the flat items with low pressure. As a result of the low pressure, a holding force is produced with which the flat items are pressed against the outer side of the run of the conveyor belts running along the suction side of the suction arrangement. As a result, the flat items lie on the conveyor belts not only with their weight from gravity, but also under the additional influence of a holding force produced by the low pressure, which is many times greater. This additional influence of the low pressure leads to increased frictional engagement of the flat items with the conveyor belts, whereby the flat items are fixed securely to the conveyor belts. In this way, it is ensured that the flat items are carried along by the conveyor belts without slipping or skidding under a stationary relative arrangement with respect to the run of the conveyor belts moving them, thus resulting in precise and reliable transport of the flat items. After all, only with the aid of such precise and reliable transport does it remain ensured that the flat items will arrive at the outlet side of the suction conveyor device at a defined location and in a defined alignment in order to then be transferred with the proper quality to a subsequent station for further processing. This is particularly important in a system of the paper processing industry for producing blocks or books preferably on the way from a cutting station to a stack forming station, where the arrangement and alignment of the sheets of paper cut to a prescribed format must remain uninfluenced and undisturbed in order to ensure error-free stack formation in the stack forming station.

As already mentioned, the continuously circulating flexible conveying means arrangement is formed from a plurality of conveyor belts that are spaced apart from each other transverse to the direction of conveyance, arranged parallel to each other and continuously running, with their upper runs being provided in many applications with their outer or upper side for receiving the flat items. The suction arrangement usually has a suction box whose suction side along which the runs of the conveyor belts conveying the flat items run is sealed with a perforated plate. The conveyor belts therefore operate with their run transporting the flat items on or along the perforated plate. The air is drawn through the openings in the perforated plate into the suction box, which is connected to a suction pump. In order to effectively impinge the flat items with low pressure, the conveyor belts are also provided with corresponding suction holes.

Even though the suction conveyor devices with the conventional construction described above have proven themselves in many applications in practice, it has been found that the sliding contact of the runs of the conveyor belts carrying the flat items leads to increased friction on the suction plate between the conveyor belts and the perforated plate, which is also in particular a result of the low pressure generated by the suction arrangement, which acts not only on the flat items but also on the conveyor belts. This friction not only generates increased resistance for the drives of the conveyor belts, which leads to increased loading of the drives and higher energy consumption, it also brings about increased wearing of the conveyor belts. Likewise, it has been observed that a flat item with its side edges extending in the direction of conveyance can come into contact with a side edge of an adjacent conveyor belt without producing an overlap, which leads to damaging of flat items, particularly on their side edges. The danger of damage caused by such collisions is increased particularly during the processing and transport of flat items of different formats, since it is not possible to adjust the conveyor belts by displacing them transverse to the direction of conveyance to adapt to different formats, or this is not possible without unreasonable effort.

It is therefore an object of the present invention to propose structural improvements for a multiple-path suction conveyor device of the type mentioned at the outset with which the abovementioned drawbacks can be substantially avoided.

The object is achieved with a suction conveyor device for transporting flat items, particularly sheets of paper, preferably on the way from a cutting station to a stack forming station in a system of the paper processing industry, with a suction arrangement having a suction side on which a low pressure is generated, and a continuously circulating flexible conveying means arrangement that consists of a flexible flat material provided with holes and an inner side with which the conveying means arrangement can be moved along the suction side of the suction arrangement, and has an outer side for receiving the flat items in the active area of the suction side of the suction arrangement where the conveying means arrangement moves in the direction of conveyance, the suction arrangement and the conveying means arrangement being embodied such that at least one transport path with a width transverse to the direction of conveyance is defined in the active area of the suction side of the suction arrangement, characterized in that the conveying means arrangement is formed by a continuously circulating, individual, single-piece flexible conveying means, both of whose lateral edges running in the direction of conveyance are spaced apart from each other by a distance that is equal to or greater than the total width of the transport path, so that the individual, single-piece flexible conveying means extends at least over the total width of the transport path.

To avoid the previously mentioned drawbacks of the prior art, the invention now proposes that the conveying means arrangement not be formed, as in the past, from a plurality of discrete and spaced-apart conveyor belts, but from a flexible conveying means that is continuously circulating but individual and in one piece and extends at least over the total width of the transport path. Accordingly, the invention does without the use of individual, spaced-apart conveyor belts, but rather proposes the use of an individual, single-piece flexible conveying means, both of whose lateral edges running in the direction of conveyance are spaced apart from each other by a distance that is equal to or greater than the total width of the transport path. The continuously circulating, individual, single-piece flexible conveying means according to the invention thus offers continuous, planar support over the total width of the transport path for a large-format flat items extending partially or completely over the total width of the transport path or for several small-format flat items lying side by side transverse to the direction of conveyance. This enables the flat items to be supported uniformly and completely and impinged with low pressure over the entire surface of the flat items, thus resulting in more effective fixation on the conveyor means. Furthermore, due to the use of an individual, single-piece flexible conveying means with a surface that is continuous over the total width of the transport path instead of a plurality of spaced-apart and discrete conveyor belts, the danger of damaging of the side edges of the flat items is averted. The solution according to the invention thus offers reliable, stable and hazard-free transport of flat items. This is especially advantageous for flat items which, due to their particular dimensions and/or materials, are especially sensitive to frictional forces and impact loads acting on their side edges and are therefore especially prone to being damaged accordingly. The solution according to the invention is therefore also particularly suited to the transport of sensitive flat items in different formats.

Another advantage of the solution according to the invention lies in its simpler assembly compared to conventional conveying means arrangements. After all, the installation of a plurality of discrete conveyor belts in the prior art is complicated and time-consuming, since the conveyor belts must be arranged successively and it is oftentimes only possible to adhere the two loose ends to form a continuous conveyor belt at the installation site, so the installation of the conventional conveying means arrangement requires a plurality of assembly steps. In contrast, the solution according to the invention, which, of course, is formed according to the invention by a continuously circulating, individual, single-piece flexible conveying means, requires substantially fewer assembly steps for installing the conveying means arrangement than the prior art; in many cases, essentially only a single assembly step is even sufficient. After all, it is possible to configure the individual, single-piece flexible conveying means into a continuously circulating arrangement before installation and then merely to arrange it at the installation site on the supports existing there. Accordingly, the solution according to the invention offers substantially simpler installation compared to the prior art.

Preferred embodiments and developments of the invention are indicated in the dependent claims.

For instance, the individual, single-piece flexible conveying means expediently consists of one continuously circulating fabric.

Furthermore, the suction arrangement and the conveying means arrangement are preferably embodied such that the suction side of the suction arrangement is essentially completely covered by the run of the continuously circulating, individual, single-piece flexible conveying means located on the suction side.

Moreover, the individual, single-piece flexible conveying means can preferably cover, at least essentially completely, the at least one suction opening embodied on the suction side of the suction arrangement.

The previously mentioned embodiments can be implemented because the conveying means arrangement according to the present invention does not comprise several spaced-apart, discrete conveyor means or conveyor belts, but rather it comprises one individual, single-piece flexible conveying means that extends over the total width of the transport path and, in that respect, includes the total width of the transport path.

Another advantage of the solution according to the invention is that a perforated plate, which is required in the prior art for guiding the several discrete conveyor belts but leads to increased friction, can be omitted.

To support the run of the continuously circulating, individual, single-piece flexible conveying means running along the suction side, at least one supporting roller or cylinder with an axis of rotation running substantially parallel to the transport path and transverse or at an angle to the direction of conveyance should preferably be arranged—when seen in the direction of conveyance—between the inlet side that is upstream and the outlet side that is downstream. Expediently, the at least one supporting roller or cylinder is arranged such that the run of the individual, single-piece flexible conveying means defining the transport path rests with an inner side oriented toward the suction side on the at least one supporting roller or cylinder. Preferably, a plurality of supporting rollers or cylinders disposed one behind the other and/or side by side transverse to the direction of conveyance is provided. With the aid of such supporting rollers or cylinders, a low-friction option for supporting the conveying means is provided in a structurally simple manner.

In order to impart additional stability to the continuously circulating, individual, single-piece flexible conveying means, means should also preferably be provided for generating a curvature oriented toward the outer side and running approximately transverse to the direction of conveyance in the conveying means, at least in sections, in the active area of the suction side of the suction arrangement.

A refinement of this embodiment in which deflecting means are provided—when seen in the direction of conveyance—both on an inlet side that is upstream and on an outlet side that is downstream for deflecting the conveying means arrangement around a deflection axis, and the suction side of the suction arrangement is located between these two deflecting means, is characterized in that at least one deflecting means has a plurality of rollers, lying side by side over the total width of the transport path and substantially transverse to the direction of conveyance and forming the means for generating the curvature, with an axis of rotation running transverse or at an angle to the direction of conveyance, the arrangement and design of the rollers being such that the distance of at least one circumferential section from the deflection axis is less for the outer rollers than for the inner rollers.

In a first variant of this refinement, the distance from the axis of rotation to the deflection axis should be greater for the inner rollers than for the outer rollers, the rollers having a substantially cylindrical shape. For this purpose, the axes of rotation of the outer rollers can be tilted with respect to the deflection axis such that the spacing thereof increases in the direction toward the inner rollers. The advantage of this variant is that conventional cylindrical rollers that can preferably have the same shape and particularly about the same radius can be used to produce the curvature.

An alternative second variant of the previously mentioned refinement is characterized in that the axes of rotation of the rollers are substantially flush with each other and coincide with the deflection axis or run parallel thereto and the rollers are embodied such that their radius increases toward the inner rollers. The outer rollers should preferably have a conical shape and the inner rollers should have an approximately cylindrical shape, which leads to simpler but nearly just as effective construction of this variant.

Another preferred embodiment is characterized in that a support frame is provided that has guiding means for guiding the individual, single-piece flexible conveying means in a continuously circulating manner and can be supported on both sides by a mount at a distance from a subsurface; of the two mounts spaced apart from each other transverse to the direction of conveyance, a first mount is detachably arranged on the support frame and a second mount is dimensioned such that, after removal of the first mount, it holds the support frame at a distance from the subsurface at least temporarily, thus assuming the function of a one-sided mount, and the support frame is embodied such that, after removal of the first mount, the individual, single-piece flexible conveying means can be pulled off, transverse to the direction of conveyance, from the support frame on the side on which the first mount is provided. This embodiment offers an especially simple possibility for the assembly of the continuously circulating, individual, single-piece flexible conveying means used according to the invention for a conveying means arrangement. After all, for assembly, it need only be introduced into the support frame on the side on which the first mount is usually provided but removed for assembly and arranged there on the guiding means, preferably placed over same. Conversely, for disassembly, after the first mount has been removed, the continuously circulating, individual, single-piece flexible conveying means can simply be pulled out of the support frame on the side on which the first mount is usually removed for the purpose of disassembly. In this embodiment, assembly and disassembly can be achieved simply in that the second mount is also capable of temporarily supporting the support frame alone and hence without the first mount hovering at a distance from the subsurface, and after the first mount has been removed, the path is free for the introduction or removal of the conveying means on the side of the support frame hovering over the subsurface at a distance. This embodiment thus offers, in a structurally deft manner, the possibility of simple installation or disassembly of the conveying means in only one assembly step.

In one refinement of the previously described embodiment, the suction arrangement is arranged in the support frame, thus resulting in an especially space-saving installation of the suction arrangement. Expediently, the support frame should form a housing for the suction arrangement.

Another embodiment is characterized in that the suction arrangement is divided on its suction side into a plurality of sections lying one behind the other in the direction of conveyance and/or side by side transverse to the direction of conveyance, and their suction force can be adjusted independently of each other. In one refinement, the suction arrangement can have at least one suction box that is divided into several chambers lying one behind the other in the direction of conveyance and/or side by side transverse to the direction of conveyance, each of which forms a section with individually adjustable suction force. As a result of ability to be adjusted by section, the suction force can be adapted especially well to the properties of the flat items to be transported and the conditions of transport, whereby the danger of damaging and particularly wrinkling of the flat items is reduced substantially. Another advantage of this embodiment is that the stability of the flat items has no or at least no substantial influence on the transport conditions and particularly the conveying speed, which can be important particularly during processing of oversized flat items due to their instability. Furthermore, through the division into sections and the adjustability of the suction arrangement, a collapse of the low pressure in the case of uncovered suction air holes and thus an uncontrolled distribution of suction air is prevented. Finally, this embodiment minimizes consumption of suction air, which leads to a reduction in operational costs.

In another embodiment that alternatively also constitutes an independent aspect of the invention, a base is provided that is made of granite, preferably of a granite block or a granite plate. A base structured in such a way according to the invention forms an especially stable and impact-proof machine bed. After all, the granite used according to the invention as the material possesses a sufficiently high specific weight to form a sturdy foundation due to the resulting heavy overall weight. Moreover, granite is particularly well suited to absorbing impacts and sound waves, which is advantageous for the execution of processes with an especially high level of precision, such as is required in a system of the paper processing industry, for example. Finally, granite is suitable for especially precise surface working, which is especially important for the arrangement and alignment of the system parts particularly if the coupling of the individual system parts with each other requires an especially high level of precision.

The base should expediently have a substantially level underside for resting on a subsurface and an upper side for holding at least one system component or assembly such as the suction arrangement and the conveying means arrangement, for example.

For the purpose of the defined alignment of the at least one assembly or system component and particularly the support frame thereof, on which the suction arrangement and the flexible conveying means for example can also be mounted, an oblong, defined reference surface that runs substantially in the direction of conveyance should be worked into the base. Preferably, the reference surface is formed on a side edge of the base or by a shoulder worked into the base. It is especially advantageous to provide the assembly or the system component and particularly the support frame thereof with at least one stop, preferably at least two stops, that is/are positioned in a defined manner or can be brought to rest against the reference surface in order to align the support frame in a defined manner. With this embodiment, it is possible in a technically especially simple and simultaneously deft manner to reproducibly bring the assemblies or system components together in the desired alignment, which is particularly advantageous in the case of repeated assembly and disassembly, particularly if the system is to first be erected in the factory for testing purposes, disassembled again for reasons relating to easy transport, and finally permanently assembled at the client's site.

In a system for the manufacture of flat items, particularly sheets of paper of the paper processing industry, and for collecting the flat items into stacks, particularly book blocks, with a cutting station for cutting flat items such that at least two rows of flat items are formed running in the direction of conveyance and lying side by side transverse to the direction of conveyance, and with a stack forming station, a suction conveyor device according to the present invention is preferably arranged behind the cutting station and upstream from the stack forming station in order to transport the at least two rows of flat items lying side by side from the cutting station to the stack forming station.

A suction conveyor device of this type is a multi-path conveying device in which several transport paths running side by side transport successive flat items. Particularly, the present device is used for transporting flat items to a stacker.

Below, a preferred exemplary embodiment of the invention will be explained in further detail with reference to the enclosed drawings.

Figure 1:
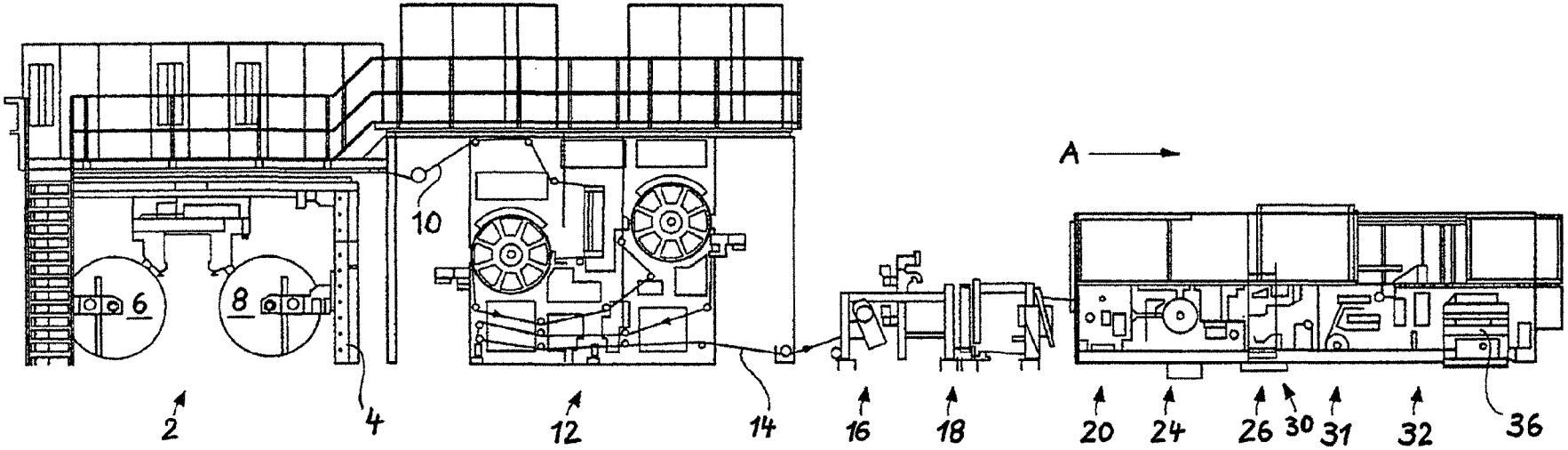
FIG. 1 shows, as an example, a schematic side view of a system for the manufacture of book blocks.

The system shown schematically and as an example in FIG. 1 includes at the beginning a sheet web delivery station 2 having a support frame 4 on which two rolls 6, 8 are rotatably mounted in the exemplary embodiment shown. Each roll 6, 8 consists of a wound continuous sheet web, preferably made of paper that is unwound for processing the roll in the system depicted. In the exemplary embodiment shown, only one roll at a time is used during operation, whereas the other roll can be exchanged in the meantime.

After leaving the sheet web delivery station 2, the sheet web, which is identified in the figures with reference symbol "10," reaches a printing station 12 in which the sheet web 10 is printed with the desired printed images.

It should additionally be noted here that the direction of travel of the sheet is from left to right in the figures, which is also indicated by arrow A. Arrow A therefore designates the direction of conveyance, which simultaneously corresponds to the process direction.

In the exemplary embodiment shown, after leaving the printing station 12, the now printed sheet web, which is now identified with reference symbol "14" for better differentiation, passes through a feed station 16, which supports the transporting of the printed sheet web 14 in the direction of travel of the web according to arrow A.

Arranged downstream from the feed station 16 in the exemplary embodiment shown is a breaking station 18 in which the sheet web 14 is folded on both sides and thus in both directions in order to remove any waviness that may have been brought about by the printing process.

Figure 2:
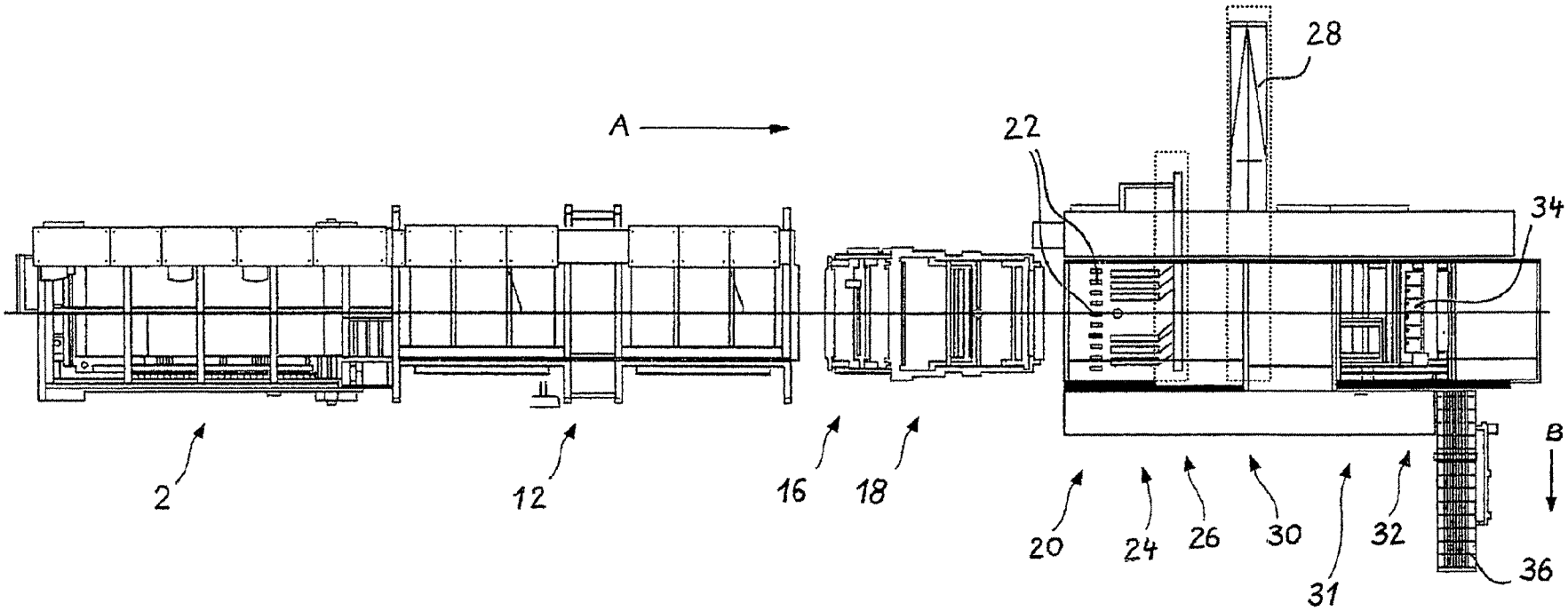
FIG. 2 shows a schematic top view of the system of FIG. 1.

Downstream in the web travel direction according to arrow A, the system has a longitudinal cutting station 20 that contains a plurality of blades 22 lying side by side transverse to the web travel direction and spaced apart from each other, as can be seen schematically in FIG. 2. The blades 22 are preferably embodied as rotationally drivable circular blades, each of whose axis of rotation is oriented transverse to the web travel direction. Furthermore, the blades 22 are each mounted so as to be transversely positionable with respect to the web travel direction of the sheet web 14, whereby the distance between two adjacent blades 22 can be changed for the purpose of format adjustment. In the longitudinal cutting station 20, the printed sheet web 14 is cut by the blades 22 in the web travel direction according to arrow A by a number of longitudinal cuts into a plurality of sub-webs, each corresponding to a desired width of a book block page (not shown in the figures). Through the changeable positionability of the individual blades 22 transverse to the travel direction of the sheet web 14, the distance between two adjacent blades 22 can be adjusted to the desired width of a book block page, thus resulting in a high level of format flexibility. Accordingly, if the width of the sheet web 14 is a multiple of the width of a page of the book block to be produced with the machine, a corresponding plurality of book blocks can be manufactured simultaneously in parallel, so that a corresponding number of parallel transport paths running in the direction of conveyance according to arrow A and lying side by side transverse to the direction of conveyance is defined (not shown in the figures).

Arranged downstream in the web travel direction downstream from the longitudinal cutting station 20 is a crosscutting station 24 in which the sub-webs cut in the longitudinal direction in the preceding longitudinal cutting station 20 are each cut into sheets simultaneously transverse to the direction of conveyance, each sheet of which constitutes a book block page for a book to be produced from the sheets. The crosscutting station 24 has a drum-like cutting cylinder extending over the entire width of the sheet web 14 with a wave-shaped blade arranged tilted with respect to the axis of rotation of the cutting cylinder (not shown in detail in the figures).

Arranged downstream from the crosscutting station 24 in the web travel direction is a sheet turnout 26 that is connected to a castoff belt 28 that leads out of the system transverse to the web travel direction, as can be seen in FIG. 2. Like all assemblies and stations of the system shown in FIGS. 1 and 2 as an example, the sheet turnout 26 is shown in FIGS. 1 and 2 only very schematically; however, it is shown in detail in FIG. 3 and will be described below in further detail using FIG. 3.

With the aid of the sheet turnout 26, substandard sheets that in particular have faulty printed images, irregularities in terms of their bonding, spread or joints or other irregularities or even damage, or empty sheets are preferably separated out and removed from the system via the castoff belt 28. For this purpose, a sensor (not shown in the figures) is provided upstream of the sheet turnout 26 that detects the number of passing sheets and determines whether the detected number of sheets corresponds to the number of pages formed from the sheets for the manufacture of the book block; it also identifies sheets to be separated out and appropriately controls the sheet turnout 26 via a control device (not shown).

Furthermore, when seen in the web travel direction according to arrow A, adjacent to the crosscutting station 24 is a suction conveyor device 30 that transports the cut sheets to the sheet turnout 26 or past it in the direction of arrow A.

Provided downstream from the suction conveyor device 30 is another conveyor device 31 that is provided as an intake assembly for a subsequent downstream collection station 32. This conveyor device 31 is preferably provided with delaying means for braking the sheets in order to transfer the sheets to the collection station 32, with the braking process particularly resulting in an overlapping of the sheets.

The collection station 32 includes a plurality of side-by-side compartments 34 that can be seen schematically in FIG. 2. These compartments 34 are each bordered by side walls (not shown in detail in the figures) that can be moved transverse to the web travel direction according to arrow A so that the width of the individual compartments 34 can be adapted to the width of the sheets cut from the individual transport paths and sub-webs. The side walls of the compartments 34 should therefore be moved appropriately to match the blades 22 of the longitudinal cutting station 20 transverse to the web travel direction so that it is ensured that the side walls of the compartments 34 assume the same transverse position in the collection station 32 as the corresponding blades 22 of the longitudinal cutting station 20. In the collection station 32 in each of the compartments 34, a stack of superposed sheets is built up that forms the desired book block upon completion, the compartments 34 being set up in a number corresponding to the number of sub-webs and transport paths, whereby a corresponding plurality of sheet stacks produced in parallel and forming book blocks are collected.

In the area of the collection station 32, gripper conveyors (not shown in the figures) are provided, one gripper conveyor preferably being associated with each of the compartments 34. The purpose of the gripper conveyors is to remove a stack collected into a complete book block from the respective compartment 34; this is achieved by clamping a stack representing a complete book block between the gripper heads of the gripper conveyor.

Moreover, FIGS. 1 and 2 show a schematic view of a transverse conveyor 36 that is adjacent to the downstream side of the collection station 32 and to which the book blocks (not shown in the figures) are transferred from the collection station 32 with the aid of the abovementioned gripper conveyor. The book blocks are then transported away from the system shown schematically in FIGS. 1 and 2 with the aid of a transverse conveyor 36. In the exemplary embodiment shown, the direction of transport or conveyance of the transverse conveyor 36 is oriented transverse to the process direction, as shown by arrow B in FIG. 2. The book blocks are thus transported off laterally in the exemplary embodiment shown with the aid of the transverse conveyor 36. The transverse conveyor 36 preferably has a conveyor belt continuously circulating in the direction of arrow B (not shown in greater detail in the figures). Preferably, the transverse conveyor 36 leads to a downstream bookbinding machine and/or to a downstream packaging machine (neither of which is shown in the figures). The stacks are then wrapped with packaging material and/or packaged in larger units in the packaging machine.

A preferred embodiment of the abovementioned suction conveyor device 30 is described below on the basis of FIGS. 3 to 8.

As can be seen particularly in FIGS. 3 and 4, one essential feature of the conveyor device 30 is that a single fabric 40 is used as the continuously circulating flexible conveying means and perforated over its entire length and width and is therefore referred to below as a suction fabric. The two lateral edges 40*a* of the suction fabric 40 running in the direction of conveyance according to arrow A are spaced apart from one another by a distance that corresponds to the total width X of the transport path, so that the suction fabric 40 extends over the total width X of the transport path. The upper run 40*b* of the continuously circulating suction fabric 40 lies on the plane of the transport path, which is thus simultaneously defined by the upper run 40*b* of the suction fabric 40.

Figure 4:
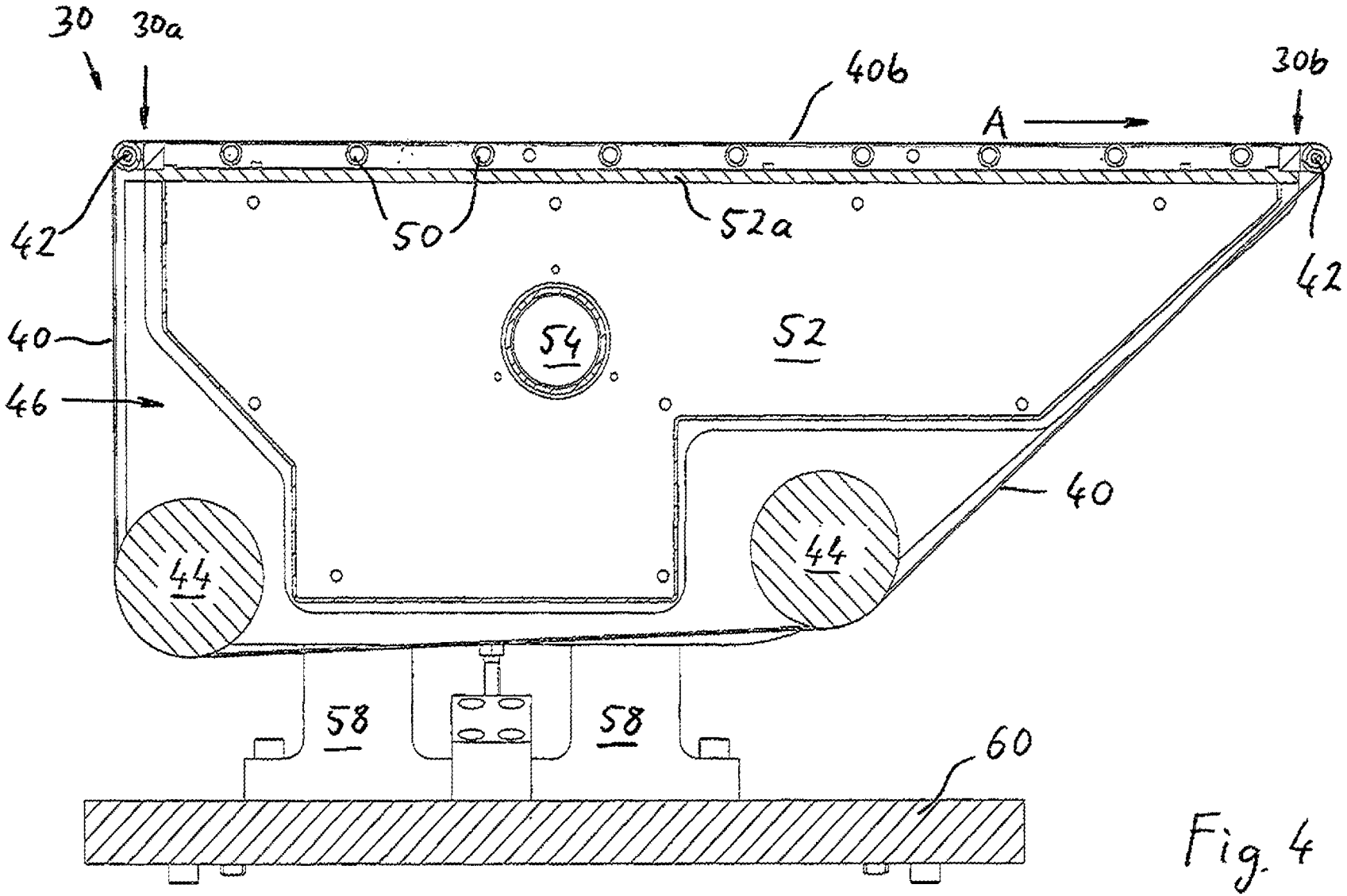
FIG. 4 shows a schematic, cross-sectional view of the suction conveyor device of FIG. 3.

As can be seen particularly in FIG. 4, the suction fabric 40 is guided via upper deflection rollers 42 and lower deflection rollers 44 that are rotatably mounted on a support frame 46. The upper deflection rollers 42 are arranged on the inlet side 30*a* and the outlet side 30*b* of the suction conveyor device 30 corresponding to the beginning and end of the upper run 40*b* of the suction fabric 40, so that the upper run 40*b* of the suction fabric 40 is formed between the upper deflection rollers 42 in the direction of conveyance according to arrow A. In order to set the continuously circulating suction fabric 40 in motion so that its upper run 40*b* runs in the direction of conveyance according to arrow A from the inlet side 30*a* to the outlet side 30*b*, a drive motor 48 is provided on one side of the support frame 46 and that drives one of the lower deflection rollers 44, thus causing it to rotate. It should also be noted here that the axes of rotation of the upper deflection rollers 42 are oriented roughly transverse and roughly parallel to the transport plane that extends from the upper run 40*b* of the suction fabric 40, and the axis of rotation of the lower deflection rollers 44 is oriented at a right angle to the direction of conveyance according to arrow A and parallel to the abovementioned transport plane.

To support the upper run 40*b* of the suction fabric 40, a plurality of supporting rollers 50 is provided that are rotatably mounted on the upper side of the support frame 46 and, when seen in the direction of conveyance according to arrow A, are arranged both one behind the other and side by side, their axes of rotation being oriented at a right angle to the direction of conveyance according to arrow A and parallel to the transport plane that extends from the upper run 40*b* of the suction fabric 40. As can be seen particularly in FIG. 4, the supporting rollers 50 lie with their axes of rotation on a common plane in the exemplary embodiment shown, whereby the upper run 40*b* of the suction fabric 40 is straight and level. As can be seen in FIG. 3, the supporting rollers 50 are not embodied in a single piece or continuous over the total width X of the transport path, since otherwise there would be the danger of the supporting rollers sagging downward. For that reason, a plurality of supporting rollers 50 are provided over the width X of the transport path and are combined into a group, with corresponding mounts (not shown in the figures) for the supporting rollers 50 being provided between the rollers 50. For this purpose, it is advantageous in comparison to FIG. 3 to arrange the supporting rollers of one group offset from the supporting rollers of the other group in order to prevent instability of the upper run 40*b* of the suction fabric 40 between two adjacent supporting rollers 50.

Provided on the support frame 46 is a housing that is embodied as a suction box and is identified by reference symbol "52." The suction box 52 is substantially closed and provided with suction openings (not shown in detail in the figures) only on its upper side 52*a*, where the previously mentioned supporting rollers 50 are arranged and along which runs the upper run 40*b* of the perforated suction fabric 40, which is provided with suction openings (not individually shown in the figures). The upper side 52*a* of the suction box 52 forming a wall can be perforated for this purpose by a plurality of relatively small holes or have only a limited number of larger openings. Alternatively, it is also possible to leave the upper side 52*a* of the suction box 52 open over substantially the entire surface covered by the upper run 40*b* of the suction fabric 40. As can also be seen in FIG. 4, the suction box 52 has a suction port 54 to which a suction pump (not shown in the figures) can be connected in order to generate low pressure in the suction box 52, whereby air is drawn through the upper side 52*a* thereof. The upper side 52*a* of the suction box 52 thus forms the so-called suction side on which the desired suction effect is produced.

Figure 3:
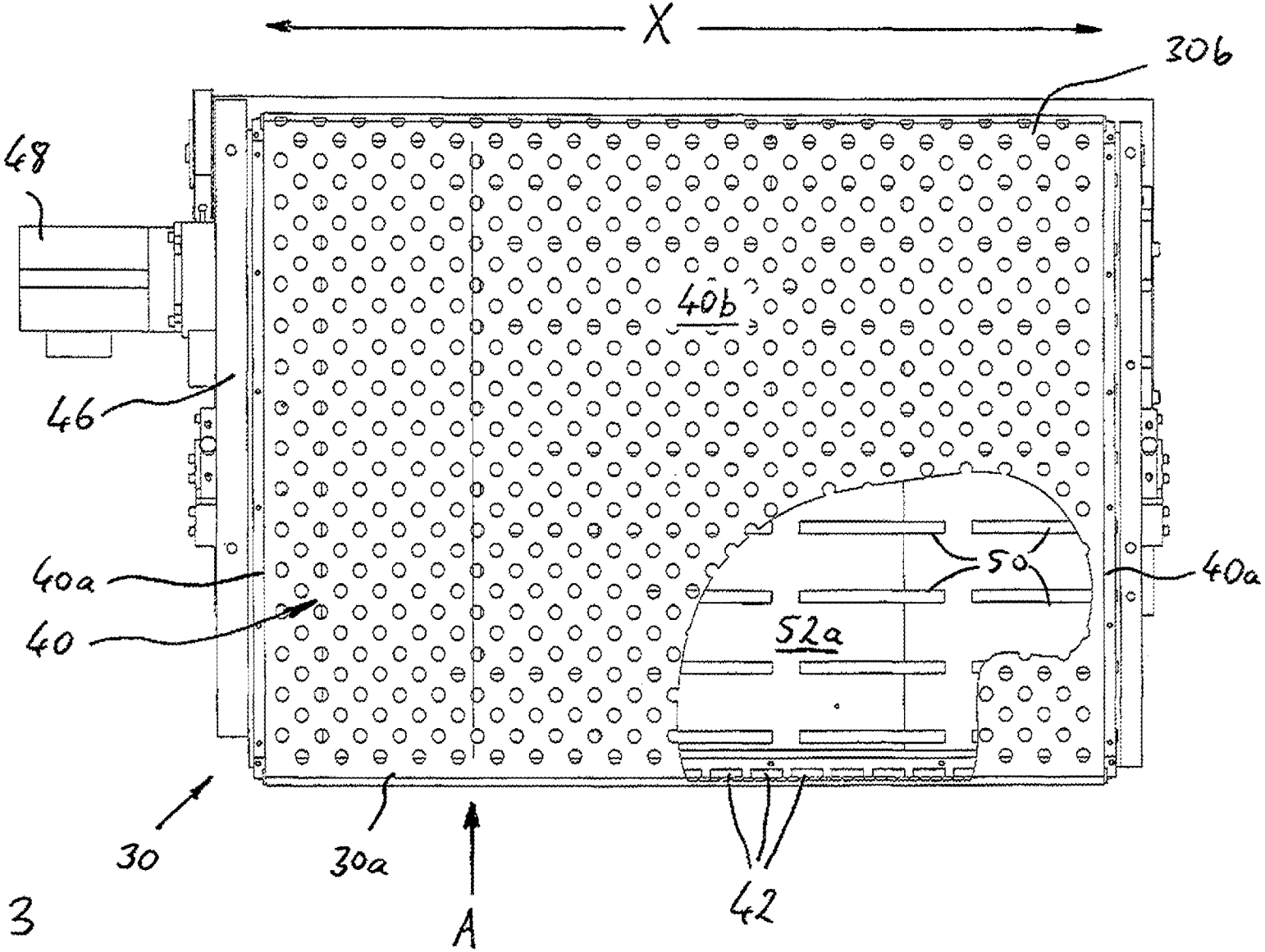
FIG. 3 shows a schematic top view of a suction conveyor device included in the system according to FIGS. 1 and 2 according to one preferred exemplary embodiment of the invention.
Figure 5:
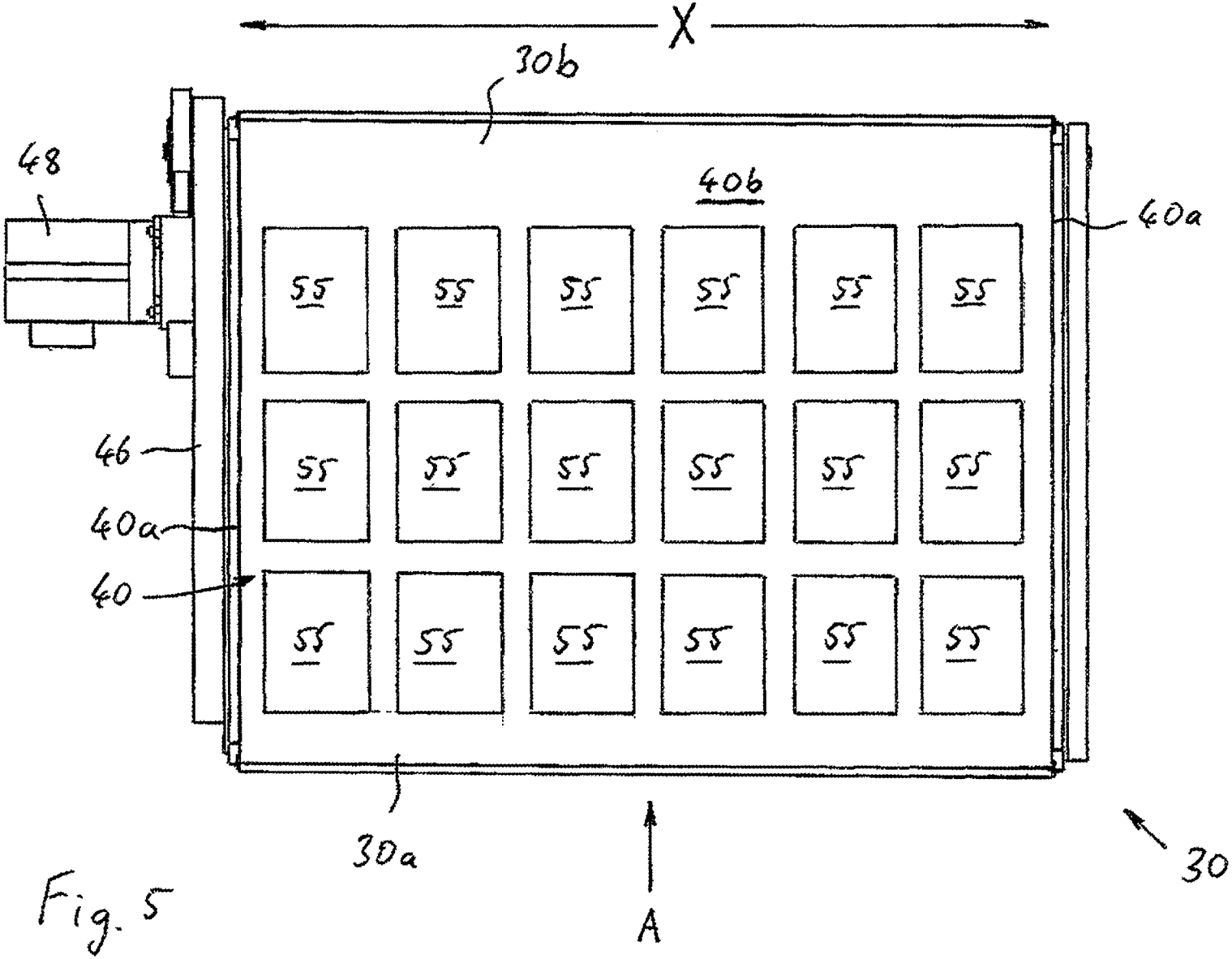
FIG. 5 shows the same view as FIG. 3 with sheets received by the suction conveyor device.

To transport the sheets 55, the latter lie on the upper run 40*b* of the suction fabric 40 and, as a result of the movement of the continuously circulating suction fabric 40, are transported in the direction of arrow A, as can be seen schematically in FIG. 5, which shows the same view as FIG. 3 but in a somewhat less detailed illustration, the suction fabric particularly being embodied without perforations. The continuously circulating suction fabric 40 thus provides for the movement in the direction of conveyance according to arrow A. As a result of the suction effect produced on the upper side 52*a* of the suction box 52, a holding force is produced with which the sheets 55 are pressed against the upper run 40*b* of the suction fabric 40. The sheets therefore lie on the upper run 40*b* of the suction fabric 40 not only under the influence of their weight from gravity, but also under the additional influence of a holding force that is produced by the low pressure on the upper side 52*a* of the suction box 52 and is many times greater. This additional influence of the suction effect and the resulting low pressure leads to increased frictional engagement of the sheets with the upper run 40*b* of the suction fabric 40, whereby the sheets are fixed securely on the upper run 40*b* of the suction fabric 40.

The suction fabric 40 extending over the total width X of the transport path and hence covering the total width X of the transport path offers continuous, flat support not only for a large-format sheet extending partially or substantially completely over the total width X of the transport path, but also for several side-by-side rows of smaller-format sheets 55 transverse to the direction of conveyance according to arrow A, as can be seen in FIG. 5, for example, which shows on the upper run 40*b* of the suction fabric 40 six side-by-side rows of sheets 55 lying one behind the other in the direction of conveyance according to arrow A. As a result, uniform and complete support of the sheets and impingement with low pressure over the entire surface of the sheets can be achieved, thus resulting in effective fixation on the suction fabric 40. This is why the suction conveyor device 30 according to the exemplary embodiment shown in FIGS. 3 through 8 is used in the system shown as an example in FIGS. 1 and 2 downstream after the crosscutting station 24, in which the sub-webs cut in the longitudinal direction in the preceding longitudinal cutting station 20 are each cut simultaneously into sheets transverse to the direction of conveyance according to arrow A, so that several rows of sheets running side by side transverse to the direction of conveyance according to arrow A lying one behind the other are created and are then received together by the suction fabric 40 of the conveyor device 30. The suction fabric 40 thus offers continuous, flat support over the total width X of the transport path for a plurality of sheets lying side by side transverse to the direction of conveyance.

The suction box 52 can be divided on its upper side 52*a* forming the suction side into a plurality of sections lying one behind the other in the direction of conveyance, according to arrow A and/or side by side transverse to the direction of conveyance, and their suction force can be adjusted independently of each other. These sections can preferably be embodied as chambers. The advantage of this embodiment, which is not shown in the figures, is that, since it can be adjusted by section, the suction force can be adapted particularly well to the properties of the sheets to be transported, thus reducing the danger of damage and particularly of the wrinkling of the sheets.

Figure 6:
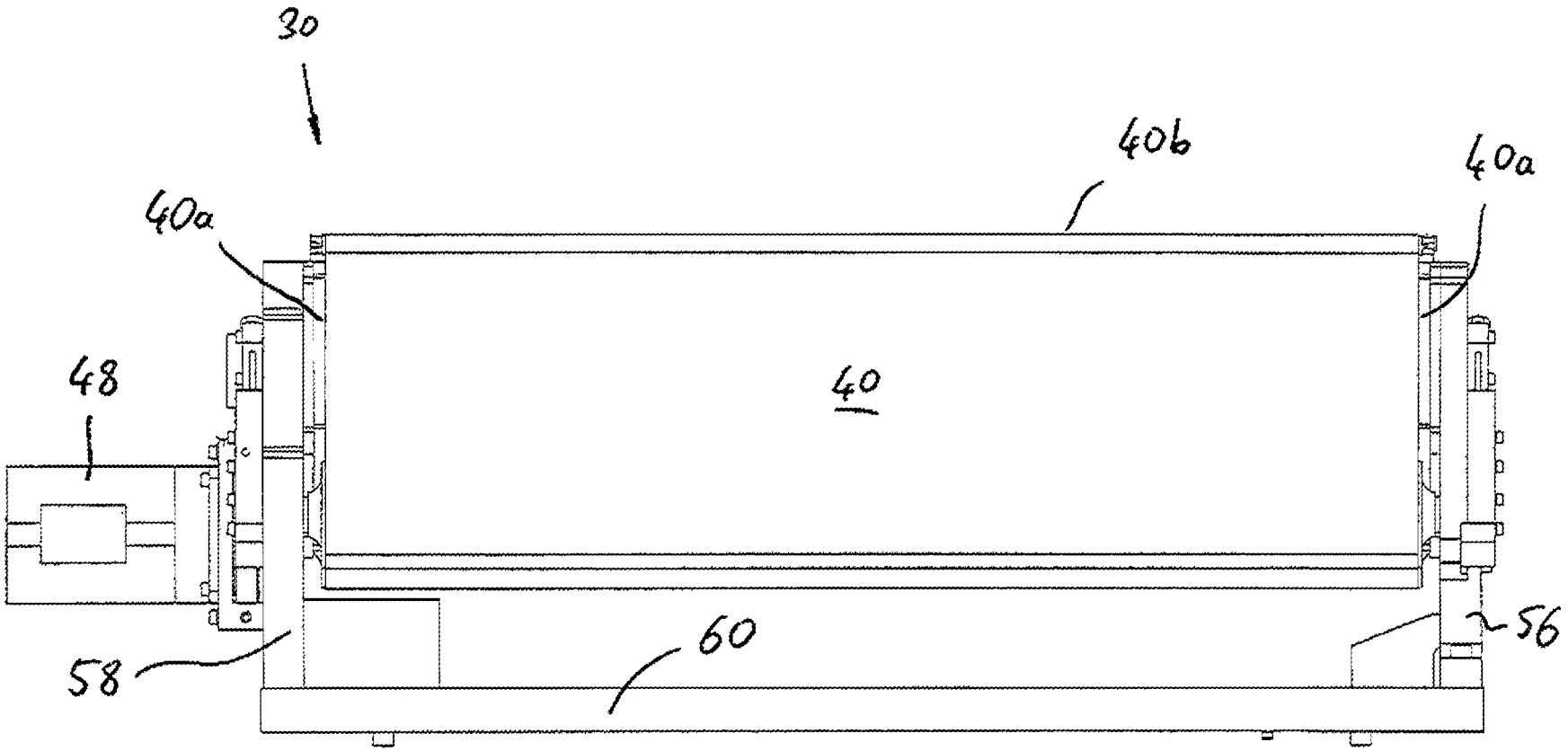
FIG. 6 shows a schematic rear view of the suction conveyor device of FIG. 3 in the normal operating state.
Figure 7:
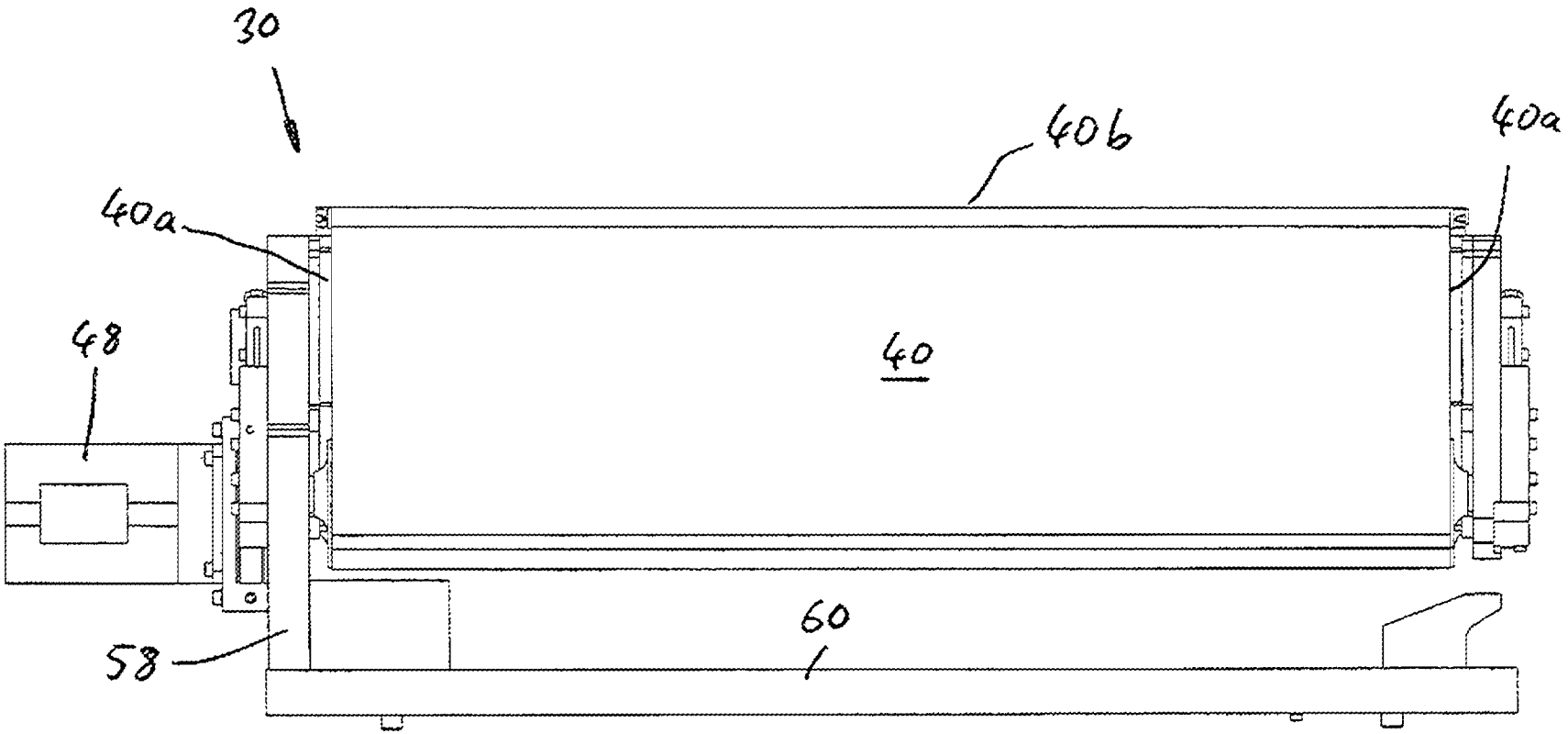
FIG. 7 shows the same view as FIG. 6, but with the suction conveyor device in a state for maintenance or for installation of the suction fabric.

As can be seen particularly in FIG. 4 in conjunction with FIG. 6, the support frame 46 is supported by support feet 56, 58 on a base plate 60 on both of its sides transverse to the direction of conveyance according to arrow A and hence opposing each other in the direction of the width X. The two support feet 56, 58 thus serve as mounts for the support frame 46 on both sides. The special characteristic of the first support foot 56 (to the right in FIG. 6) is that it can be removed from the support frame 46, and if the second support foot 58 (to the left in FIG. 6), adjacent to which, incidentally, the drive 48 is mounted on the corresponding side of the support frame 46, is designed such that it holds the support frame 46 at least temporarily at a distance from the base plate 60 after the first support foot 56 has been removed and thus assumes the function of a one-sided mount, as can be seen in FIG. 7. In this state, as shown in FIG. 7, the suction fabric 40 can be pulled off of the support frame 46 transverse to the direction of conveyance according to arrow A or in the direction of the width X of the transport path on the side on which the first support foot 56 is provided in the normal state according to FIG. 6 and is now temporarily removed. For this purpose, the support frame 46 and the arrangement of the deflection rollers 42, 44 and of the supporting rollers 50 are embodied such that, after the first support foot 56 has been removed, the continuously circulating suction fabric 40 can easily be pulled off of the abovementioned rollers 42, 44, 50 and removed from the support frame 46 and, conversely, also introduced easily into the support frame 46 and pulled over the abovementioned rollers 42, 44, 50. Accordingly, the design of the suction conveyor device 30 according to the exemplary embodiment shown enables simple assembly of the suction fabric 40 in an already continuous configuration, so that a suction fabric 40 can be used for assembly that has already been glued at its two ends into a continuous configuration in the factory. Conversely but similarly, the continuous suction fabric 40 can easily be removed, so that appropriate maintenance can be performed quickly and cost-effectively. To aid in understanding, it should also be pointed out here that, for reasons of better clarity, the suction fabric 40 is shown without perforations in FIGS. 6 and 7.

Figure 8:
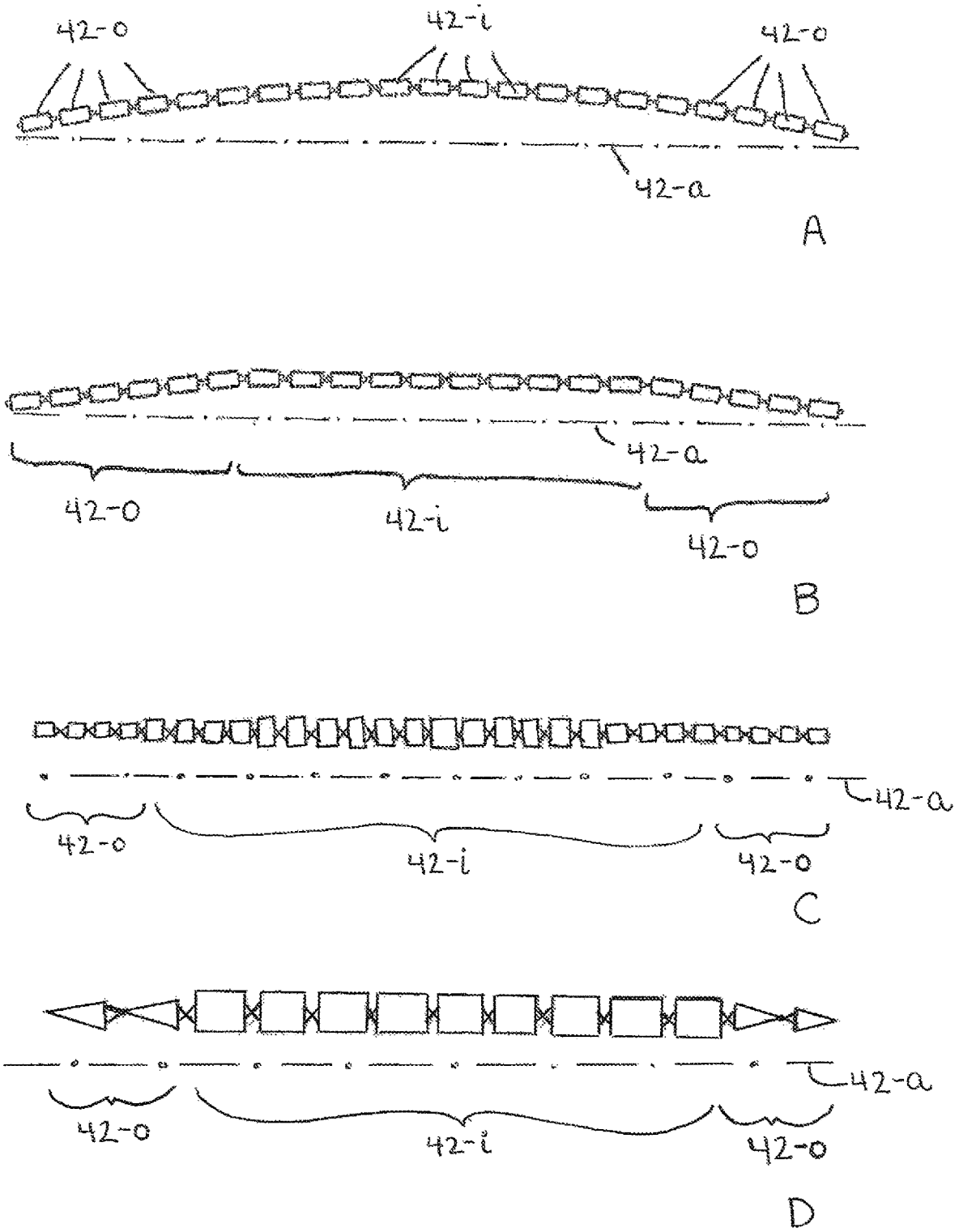
FIG. 8 shows a schematic individual representation of a group of deflection rollers in a configuration according to a first preferred embodiment (a), in a configuration according to a second preferred embodiment (b), in a configuration according to a third embodiment (c), and in a configuration according to a fourth embodiment (d)

In order to impart additional stability to the continuously circulating suction fabric 40, a slight upwardly directed curvature is provided on the deflection rollers 42. For this purpose, the deflection rollers 42 must be embodied and arranged appropriately, two configurations being shown in FIG. 8 as examples. As can be seen in FIG. 8, the rollers shown therein have a cylindrical shape and substantially the same measurements. It can also be seen from FIG. 8 that a plurality of rollers are combined into a common deflection roller arrangement that is preferably provided on the inlet side 30*a* and/or on the outlet side 30*b* of the suction conveyor device 30. In each deflection roller arrangement, in turn, several rollers each are combined into a group, as is defined in FIG. 8. Each of the outer rollers 42-*o*, which are arranged adjacent to the lateral edges 40*a* of the continuously circulating fabric 40*b*, and each of the inner and middle rollers 42-*i* are combined into groups. The two configurations shown in FIG. 8 concurrently show that the distance from a virtual deflection axis 42-*a* is greater in the group of the inner rollers 42-*i* than in the two groups of the outer rollers 42-*o*. In the configuration according to FIG. 8*a*, the deflection roller arrangement forms a substantially continuous, slightly curved arch, so that the axes of rotation of every two adjacent rollers are slightly angled with respect to each other. In contrast, in the configuration according to FIG. 8*b*, the rollers of each group are arranged so as to be axially flush with each other, so that the axes of rotation of each group lie on a common straight line or axis. The group of the inner rollers 42-*i* is arranged substantially parallel to the virtual deflection axis 42-*a*, whereas the two groups of the outer rollers 42-*o* are oriented at an angle to the deflection axis 42-*a* at a distance that decreases toward the outside. Alternative configurations have the axes of rotation of the rollers substantially aligned with each other and coinciding with the deflection axis, or running parallel thereto. In the configuration of 8*c*, the rollers are embodied such that their radius increases toward the inner rollers 42-*i*. In the configuration of 8*d*, the outer rollers 42-*o* have a conical shape and the inner rollers 42-*i* have an approximately cylindrical shape.

Figure 9:
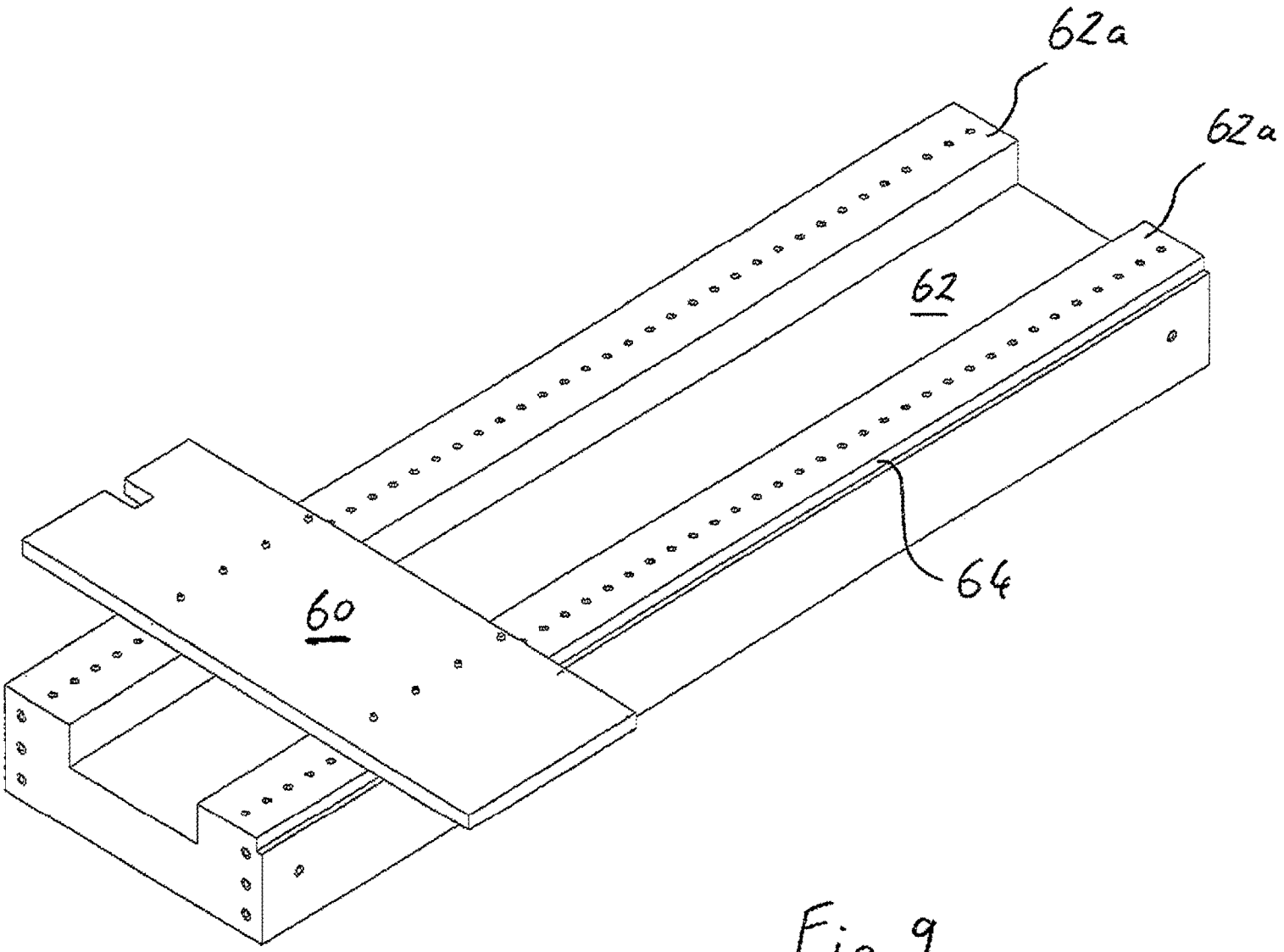
FIG. 9 shows a schematic, perspective view of a machine bed according to one preferred embodiment of the invention.
Figure 10:
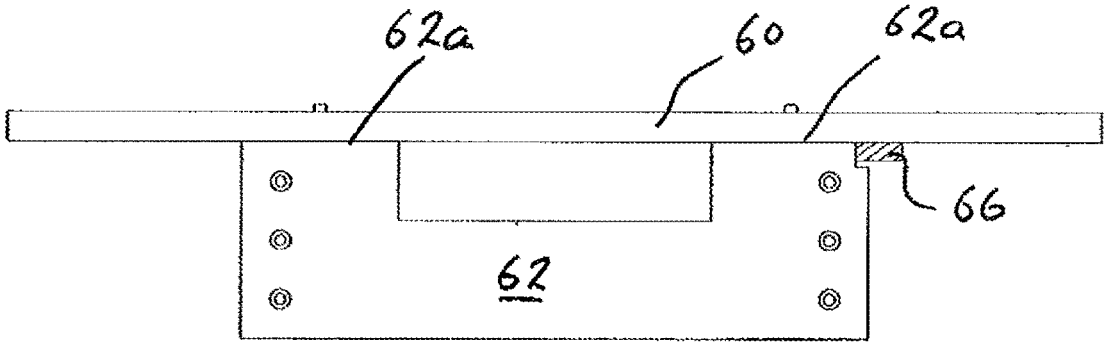
FIG. 10 shows the machine bed of FIG. 9 in a front view.
Figure 11:
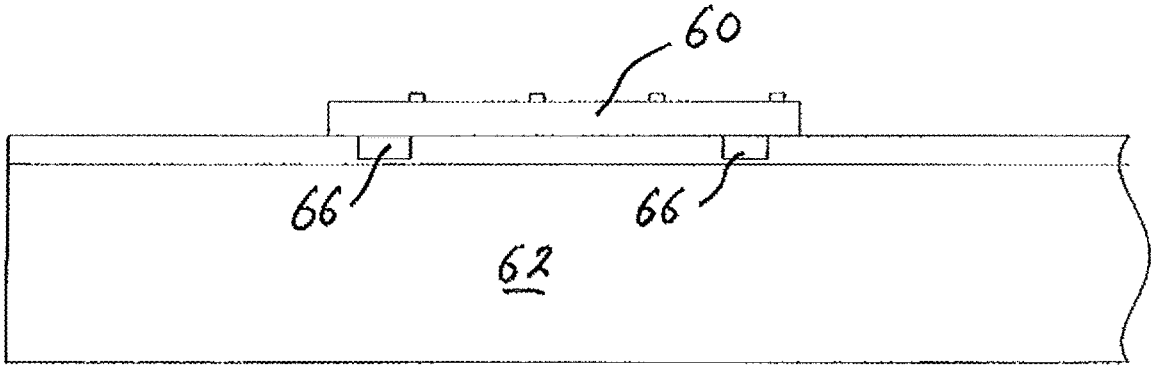
FIG. 11 shows the machine bed of FIG. 9 in a sectional side view.

To support the base plate 60 shown in FIGS. 4, 6 and 7, a machine bed can be used as a foundation or base; this is shown in FIGS. 9 to 11 as an example and identified with the reference symbol "62." The special feature of the machine bed 62 used in the exemplary embodiment shown is that it is made of a granite plate. This results in an especially stable and impact-resistant foundation. To support and attach the base plate 60, the machine bed 62 has two assembly surfaces 62*a* that are ground precisely in order to form a defined common assembly plane. As can also be seen in FIG. 9, a series of holes is worked into each of these two assembly surfaces 62*a*; these holes are not shown in further detail in the figures and generally consist of threaded bores. The base plate 60 has corresponding through-holes that are also not individually identified in the figures and—although there are half as many in the exemplary embodiment shown—are aligned correspondingly with the threaded bores in the machine bed 62. This makes it possible to screw the base plate 60, and hence the suction conveyor device 30 installed thereon, to a desired location on the machine bed 62 via the support frame 46.

Furthermore, particularly FIGS. 9 and 11 show that a shoulder 64 is worked in the machine bed 62 along one longitudinal side. This shoulder forms an oblong, defined reference surface 64, the machine bed 62 preferably being aligned such that the shoulder forming the reference surface 64 runs in the process or transporting direction of the system according to arrow A as shown in FIGS. 1 and 2. The reference surface 64 serves as a support for stops 66 that are arranged on the underside of the base plate 60, as can be seen in FIGS. 10 and 11. According to FIG. 11, two spaced-apart stops 66 are preferably provided. The stops 66 are positioned in a defined manner on the base plate 60 in order to be able to be brought into contact with the reference surface 64 for defined alignment of the base plate 60. In this way it is possible to reproducibly align assemblies or system components such as the suction conveyor device 30 installed in the present case on the base plate 60, for example, and/or the longitudinal and crosscutting stations 20, 24 of the system shown schematically in FIGS. 1 and 2 in a desired defined alignment, which is advantageous particularly in case of repeated assembly and disassembly.

What is claimed is:

1. A system for manufacturing sheets of paper and for collecting the sheets of paper into stacks, the system comprising:

a sheet web delivery station having a support frame on which a roll is rotatably mounted, the roll comprising a wound continuous paper sheet web that is unwound for processing the roll in the system;

a cutting station downstream of the sheet web delivery station for cutting the paper sheet web into sheets of paper;

a stack-forming station for stacking the sheets of paper; and a suction conveyor device for transporting the sheets of paper from the cutting station to the stack-forming station, wherein the suction conveyor device comprises:

a support frame supporting the suction conveyor device on a subsurface;

a suction arrangement arranged in the support frame and having a suction side on which low pressure is generated; and a conveying arrangement that comprises a continuously circulating, individual, single-piece flexible conveyor comprising a flexible flat material provided with holes and having an inner side with which the conveyor moves along the suction side of the suction arrangement in a direction of conveyance of the sheets of paper and having an outer side that receives the sheets of paper in an active area of the suction side of the suction arrangement;

wherein the suction arrangement and the conveying arrangement comprise at least one transport path with a total width transverse to the direction of conveyance and defined in the active area of the suction side of the suction arrangement;

wherein the conveyor has two lateral edges running in the direction of conveyance that are spaced apart from each other by a distance that is at least equal to the total width of the transport path, so that the conveyor extends at least over the total width of the transport path;

wherein an upstream deflector is provided on an inlet side of the suction conveyor device that is upstream in the direction of conveyance, and wherein a downstream deflector is provided on an outlet side of the suction conveyor device that is downstream in the direction of conveyance, both the upstream and downstream deflectors deflecting the conveyor around a respective deflection axis, and the suction side of the suction arrangement is located between the upstream and downstream deflectors;

wherein a means is provided for generating a curvature in the conveyor oriented toward the outer side and running approximately transverse to the direction of conveyance in the active area of the suction side of the suction arrangement;

wherein at least one of the upstream and downstream deflectors has a plurality of rollers lying side-by-side over the total width of the transport path and substantially transverse to the direction of conveyance, forming the means for generating the curvature and having respective axes of rotation running transverse or at an angle to the direction of conveyance, wherein the plurality of rollers is arranged such that a distance of a circumferential outer surface of at least one roller from the respective deflection axis of the at least one of the upstream and downstream deflectors is less for one or more outer rollers, which are arranged proximate at least one of the lateral edges of the conveyor, than for one or more inner rollers, which are arranged between the lateral edges of the conveyor;

wherein at least one supporting roller or cylinder is arranged between the inlet side and the outlet side and has an axis of rotation running substantially parallel to the transport path and transverse or at an angle to the direction of conveyance to support an upper run of the conveyor defining the transport path;

wherein distances from the axes of rotation of the rollers forming the means for generating the curvature to the respective deflection axis of the at least one of the upstream and downstream deflectors are greater for the one or more inner rollers than for the one or more outer rollers, the inner and outer rollers having a substantially cylindrical shape; and wherein the axes of rotation of the outer rollers are tilted with respect to the respective deflection axis of the at least one of the upstream and downstream deflectors such that the distances between the axes of rotation of the outer rollers and the respective deflection axis of the at least one of the upstream and downstream deflectors increase in a direction toward the inner rollers.

2. The system of claim 1, wherein the inner and outer rollers have approximately the same radius.

3. The system of claim 1, wherein the axes of rotation of the rollers forming the means for generating the curvature and the axis of rotation of the at least one supporting roller or cylinder lie above an upper side of the suction arrangement.

4. The system of claim 1, further comprising a plurality of supporting rollers or cylinders, including the at least one supporting roller or cylinder, disposed one behind the other in the direction of conveyance and/or side-by-side transverse to the direction of conveyance.

5. The system of claim 1, wherein the support frame forms a housing for the suction arrangement.

6. The system of claim 1, wherein the transport path is configured such that the total width thereof enables at least two sheets of paper lying side-by-side transverse to the direction of conveyance to be received simultaneously.

7. A method for transporting sheets of paper from a sheet web delivery station to a stack-forming station in a system as set forth in claim 1.

8. A system for manufacturing sheets of paper and for collecting the sheets of paper into stacks, the system comprising:

a sheet web delivery station having a support frame on which a roll is rotatably mounted, the roll comprising a wound continuous paper sheet web that is unwound for processing the roll in the system;

a cutting station downstream of the sheet web delivery station for cutting the paper sheet web into sheets of paper;

a stack-forming station for stacking the sheets of paper; and a suction conveyor device for transporting the sheets of paper from the cutting station to the stack-forming station, wherein the suction conveyor device comprises:

a support frame supporting the suction conveyor device on a subsurface;

a suction arrangement arranged in the support frame and having a suction side on which low pressure is generated; and a conveying arrangement that comprises a continuously circulating, individual, single-piece flexible conveyor comprising a flexible flat material provided with holes and having an inner side with which the conveyor moves along the suction side of the suction arrangement in a direction of conveyance of the sheets of paper and having an outer side that receives the sheets of paper in an active area of the suction side of the suction arrangement;

wherein the suction arrangement and the conveying arrangement comprise at least one transport path with a total width transverse to the direction of conveyance and defined in the active area of the suction side of the suction arrangement;

wherein the conveyor has two lateral edges running in the direction of conveyance that are spaced apart from each other by a distance that is at least equal to the total width of the transport path, so that the conveyor extends at least over the total width of the transport path;

wherein an upstream deflector is provided on an inlet side of the suction conveyor device that is upstream in the direction of conveyance, and wherein a downstream deflector is provided on an outlet side of the suction conveyor device that is downstream in the direction of conveyance, both the upstream and downstream deflectors deflecting the conveyor around a respective deflection axis, and the suction side of the suction arrangement is located between the upstream and downstream deflectors;

wherein a means is provided for generating a curvature in the conveyor oriented toward the outer side and running approximately transverse to the direction of conveyance in the active area of the suction side of the suction arrangement;

wherein at least one of the upstream and downstream deflectors has a plurality of rollers lying side-by-side over the total width of the transport path and substantially transverse to the direction of conveyance, forming the means for generating the curvature and having respective axes of rotation running transverse or at an angle to the direction of conveyance, wherein the plurality of rollers is arranged such that a distance of a circumferential outer surface of at least one roller from the respective deflection axis of the at least one of the upstream and downstream deflectors is less for one or more outer rollers, which are arranged proximate at least one of the lateral edges of the conveyor, than for one or more inner rollers, which are arranged between the lateral edges of the conveyor;

wherein at least one supporting roller or cylinder is arranged between the inlet side and the outlet side and has an axis of rotation running substantially parallel to the transport path and transverse or at an angle to the direction of conveyance to support an upper run of the conveyor defining the transport path; and wherein a group of inner rollers is arranged such that the axes of rotation of the inner rollers are offset from and substantially parallel to the respective deflection axis of the at least one of the upstream and downstream deflectors, and groups of outer rollers on opposite sides of the group of inner rollers are arranged such that the axes of rotation of the outer rollers are oriented at an angle to the respective deflection axis of the at least one of the upstream and downstream deflectors.

9. The system of claim 8, wherein the axes of rotation of the rollers forming the means for generating the curvature and the axis of rotation of the at least one supporting roller or cylinder lie above an upper side of the suction arrangement.

10. The system of claim 8, further comprising a plurality of supporting rollers or cylinders, including the at least one supporting roller or cylinder, disposed one behind the other in the direction of conveyance and/or side-by-side transverse to the direction of conveyance.

11. The system of claim 8, wherein the support frame forms a housing for the suction arrangement.

12. The system of claim 8, wherein the transport path is configured such that the total width thereof enables at least two sheets of paper lying side-by-side transverse to the direction of conveyance to be received simultaneously.

13. A method for transporting sheets of paper from a sheet web delivery station to a stack-forming station in a system as set forth in claim 8.

14. The system of claim 8, wherein the inner and outer rollers have approximately the same radius.

15. A system for manufacturing sheets of paper and for collecting the sheets of paper into stacks, the system comprising:

a sheet web delivery station having a support frame on which a roll is rotatably mounted, the roll comprising a wound continuous paper sheet web that is unwound for processing the roll in the system;

a cutting station downstream of the sheet web delivery station for cutting the paper sheet web into sheets of paper;

a stack-forming station for stacking the sheets of paper; and a suction conveyor device for transporting the sheets of paper from the cutting station to the stack-forming station, wherein the suction conveyor device comprises:

a support frame supporting the suction conveyor device on a subsurface;

a suction arrangement arranged in the support frame and having a suction side on which low pressure is generated;

a conveyor device comprising a continuously circulating conveyor belt provided with holes and having an inner side with which the conveyor belt moves along the suction side of the suction arrangement in a direction of conveyance and having an outer side that receives the sheets of paper, wherein the suction arrangement and the conveyor device comprise at least one transport path having a width defined transverse to the direction of conveyance, and the conveyor belt extends at least over the total width of the transport path;

a plurality of rollers lying side-by-side over the width of the transport path and substantially transverse to the direction of conveyance at an inlet side of the conveyor device, and a plurality of rollers lying side-by-side over the width of the transport path and substantially transverse to the direction of conveyance at an outlet side of the conveyor device, wherein the pluralities of rollers generate a curvature in the conveyor belt at the inlet and outlet sides of the conveyor device, the curvature being oriented toward the outer side of the conveyor belt and running approximately transverse to the direction of conveyance, such that the conveyor belt is deflected about respective deflection axes at the inlet and outlet sides of the conveyor device; and at least one supporting roller or cylinder arranged between the inlet side and the outlet side of the conveyor device and having an axis of rotation running substantially parallel to the transport path and transverse or at an angle to the direction of conveyance to support an upper run of the conveyor belt;

wherein the pluralities of rollers are arranged such that a distance of a circumferential outer surface of at least one roller from the respective deflection axis is less for one or more outer rollers, which are arranged proximate opposite lateral edges of the conveyor belt, than for one or more inner rollers, which are arranged between the lateral edges of the conveyor belt;

wherein axes of rotation of the pluralities of rollers generating the curvature in the conveyor belt and the axis of rotation of the at least one supporting roller or cylinder lie above an upper side of the suction arrangement; and wherein distances from the axes of rotation of the pluralities of rollers generating the curvature in the conveyor belt to the respective deflection axis are greater for the inner rollers than for the outer rollers.

16. A system for manufacturing sheets of paper and for collecting the sheets of paper into stacks, the system comprising:

a sheet web delivery station having a support frame on which a roll is rotatably mounted, the roll comprising a wound continuous paper sheet web that is unwound for processing the roll in the system;

a cutting station downstream of the sheet web delivery station for cutting the paper sheet web into sheets of paper;

a stack-forming station for stacking the sheets of paper; and a suction conveyor device for transporting the sheets of paper from the cutting station to the stack-forming station, wherein the suction conveyor device comprises:

a support frame supporting the suction conveyor device on a subsurface;

a suction arrangement arranged in the support frame and having a suction side on which low pressure is generated;

a conveyor device comprising a continuously circulating conveyor belt provided with holes and having an inner side with which the conveyor belt moves along the suction side of the suction arrangement in a direction of conveyance and having an outer side that receives the sheets of paper, wherein the suction arrangement and the conveyor device comprise at least one transport path having a width defined transverse to the direction of conveyance, and the conveyor belt extends at least over the total width of the transport path;

a plurality of rollers lying side-by-side over the width of the transport path and substantially transverse to the direction of conveyance at an inlet side of the conveyor device, and a plurality of rollers lying side-by-side over the width of the transport path and substantially transverse to the direction of conveyance at an outlet side of the conveyor device, wherein the pluralities of rollers generate a curvature in the conveyor belt at the inlet and outlet sides of the conveyor device, the curvature being oriented toward the outer side of the conveyor belt and running approximately transverse to the direction of conveyance, such that the conveyor belt is deflected about respective deflection axes at the inlet and outlet sides of the conveyor device; and at least one supporting roller or cylinder arranged between the inlet side and the outlet side of the conveyor device and having an axis of rotation running substantially parallel to the transport path and transverse or at an angle to the direction of conveyance to support an upper run of the conveyor belt;

wherein the pluralities of rollers are arranged such that a distance of a circumferential outer surface of at least one roller from the respective deflection axis is less for one or more outer rollers, which are arranged proximate opposite lateral edges of the conveyor belt, than for one or more inner rollers, which are arranged between the lateral edges of the conveyor belt;

wherein axes of rotation of the pluralities of rollers generating the curvature in the conveyor belt and the axis of rotation of the at least one supporting roller or cylinder lie above an upper side of the suction arrangement; and wherein a group of the inner rollers is arranged such that axes of rotation of the inner rollers are offset from and substantially parallel to the respective deflection axis, and groups of the outer rollers on opposite sides of the group of inner rollers are arranged such that axes of rotation of the outer rollers are oriented at an angle to the respective deflection axis.

17. A system for manufacturing sheets of paper and for collecting the sheets of paper into stacks, the system comprising:

a sheet web delivery station having a support frame on which a roll is rotatably mounted, the roll comprising a wound continuous paper sheet web that is unwound for processing the roll in the system;

a cutting station downstream of the sheet web delivery station for cutting the paper sheet web into sheets of paper;

a stack-forming station for stacking the sheets of paper; and a suction conveyor device for transporting the sheets of paper from the cutting station to the stack-forming station, wherein the suction conveyor device comprises:

a support frame supporting the suction conveyor device on a subsurface;

a suction arrangement arranged in the support frame and having a suction side on which low pressure is generated;

a continuously circulating, single-piece flexible flat material having an upper run that moves in a direction of conveyance of the sheets of paper from upstream to downstream, the flexible flat material having holes therethrough, an inner side facing the suction side of the suction arrangement, and an outer side that receives the sheets of paper;

a plurality of upstream deflection rollers and a plurality of downstream deflection rollers respectively supporting the flexible flat material on the inner side, both of the pluralities of upstream and downstream deflection rollers having axes of rotation running transverse or at an angle to the direction of conveyance and deflecting the flexible flat material above a respective upstream or downstream deflection axis over a total width of the flexible flat material; and at least one supporting roller or cylinder arranged between the plurality of upstream deflection rollers and the plurality of downstream deflection rollers and having an axis of rotation running transverse or at an angle to the direction of conveyance and supporting the upper run of the flexible flat material on the inner side;

wherein the suction side of the suction arrangement is located between the plurality of upstream deflection rollers and the plurality of downstream deflection rollers;

wherein each of the pluralities of upstream and downstream deflection rollers comprises outer rollers, which are arranged proximate at least one of two opposite lateral edges of the flexible flat material, and inner rollers, which are arranged between the lateral edges of the flexible flat material;

wherein each of the pluralities of upstream and downstream deflection rollers is arranged such that a distance of a circumferential outer surface of at least one roller from the respective upstream or downstream deflection axis is less for one or more of the outer rollers than for one or more of the inner rollers; and wherein the axes of rotation of the inner and outer rollers are offset from the respective upstream or downstream deflection axis, and the axes of rotation of the inner rollers are offset from the respective upstream or downstream deflection axis by greater distances than are the axes of rotation of the outer rollers.

18. A system for manufacturing sheets of paper and for collecting the sheets of paper into stacks, the system comprising:

a sheet web delivery station having a support frame on which a roll is rotatably mounted, the roll comprising a wound continuous paper sheet web that is unwound for processing the roll in the system;

a cutting station downstream of the sheet web delivery station for cutting the paper sheet web into sheets of paper;

a stack-forming station for stacking the sheets of paper; and a suction conveyor device for transporting the sheets of paper from the cutting station to the stack-forming station, wherein the suction conveyor device comprises:

a support frame supporting the suction conveyor device on a subsurface;

a suction arrangement arranged in the support frame and having a suction side on which low pressure is generated;

a continuously circulating, single-piece flexible flat material having an upper run that moves in a direction of conveyance of the sheets of paper from upstream to downstream, the flexible flat material having holes therethrough, an inner side facing the suction side of the suction arrangement, and an outer side that receives the sheets of paper;

a plurality of upstream deflection rollers and a plurality of downstream deflection rollers respectively supporting the flexible flat material on the inner side, both of the pluralities of upstream and downstream deflection rollers having axes of rotation running transverse or at an angle to the direction of conveyance and deflecting the flexible flat material above a respective upstream or downstream deflection axis over a total width of the flexible flat material; and at least one supporting roller or cylinder arranged between the plurality of upstream deflection rollers and the plurality of downstream deflection rollers and having an axis of rotation running transverse or at an angle to the direction of conveyance and supporting the upper run of the flexible flat material on the inner side;

wherein the suction side of the suction arrangement is located between the plurality of upstream deflection rollers and the plurality of downstream deflection rollers;

wherein each of the pluralities of upstream and downstream deflection rollers comprises outer rollers, which are arranged proximate at least one of two opposite lateral edges of the flexible flat material, and inner rollers, which are arranged between the lateral edges of the flexible flat material;

wherein each of the pluralities of upstream and downstream deflection rollers is arranged such that a distance of a circumferential outer surface of at least one roller from the respective upstream or downstream deflection axis is less for one or more of the outer rollers than for one or more of the inner rollers; and wherein the inner rollers are arranged such that the axes of rotation of the inner rollers are offset from and substantially parallel to the respective upstream or downstream deflection axis, and the outer rollers are arranged such that the axes of rotation of the outer rollers are oriented at an angle to the respective upstream or downstream deflection axis.

* * * * *